US008327793B1

(12) United States Patent
Healy

(10) Patent No.: US 8,327,793 B1
(45) Date of Patent: Dec. 11, 2012

(54) DOOR KNOCKER

(76) Inventor: Michael Healy, Uxbridge, MA (US)

( * ) Notice: Subject to any disclaimer, the term of this patent is extended or adjusted under 35 U.S.C. 154(b) by 461 days.

(21) Appl. No.: 12/651,588

(22) Filed: Jan. 4, 2010

(51) Int. Cl.
*E06B 7/28* (2006.01)

(52) U.S. Cl. ..... 116/148; 116/DIG. 12

(58) Field of Classification Search ..... 116/1, 148, 116/167, 200, DIG. 12; 40/617; 49/171
See application file for complete search history.

(56) References Cited

U.S. PATENT DOCUMENTS

| | | | | | |
|---|---|---|---|---|---|
| 602,573 | A | * | 4/1898 | Coggeshall | 116/172 |
| D72,060 | S | | 2/1927 | Doggett | |
| D73,420 | S | | 9/1927 | Whitaker | |
| D131,203 | S | | 1/1942 | Beach | |
| D160,859 | S | | 11/1950 | Harker | |
| D162,344 | S | | 3/1951 | Rains | |
| D193,836 | S | * | 10/1962 | Block | D8/401 |
| D223,993 | S | | 6/1972 | Bethune | |
| D245,310 | S | | 8/1977 | Fenice | |
| D245,311 | S | * | 8/1977 | Galanthay | D8/401 |
| D253,749 | S | | 12/1979 | Paulich | |
| D281,394 | S | | 11/1985 | Porta | |
| D284,937 | S | * | 8/1986 | Shaw | D8/401 |
| D378,799 | S | * | 4/1997 | Erickson | D8/401 |
| D403,238 | S | | 12/1998 | Burris | |
| 6,285,294 | B1 | * | 9/2001 | Avinger | 340/691.1 |
| D536,959 | S | | 2/2007 | Baskauskas et al. | |
| D625,592 | S | * | 10/2010 | Healy | D8/401 |
| D625,593 | S | * | 10/2010 | Healy | D8/401 |

OTHER PUBLICATIONS

"Brass Door Knockers, Horse Door Knockers" as printed from the website for Oriental Metal Works, date unknown, 4 pages.
"Dog Small Door Knockers / Cabinet Pulls" as printed from the website for a Cast of Characters, date unknown, 5 pages.
"Pineapple Door Knocker" as printed from the website for Jefferson Brass Company, date unknown, 1 page.

* cited by examiner

*Primary Examiner* — R. A. Smith
(74) *Attorney, Agent, or Firm* — Salter & Michaelson

(57) ABSTRACT

A door knocker including a front display piece that is in the form of an alpha character piece including a front facing surface for display of the alpha character and a rear facing surface having at least one rearwardly directed flange member that forms part of a pivot means for the front display piece, and a rear support piece that is adapted for attachment to the face of the door. The rear support piece includes at least a first leg for pivotal engagement with the flange member and forming another part of the pivot means, a second leg that is for attachment to the door, and a third leg that forms a knocker that is selectively engageable with the rear facing surface of the alpha character piece.

20 Claims, 19 Drawing Sheets

DOOR KNOCKER

FIELD OF THE INVENTION

The present invention relates in general to a new and improved door knocker and pertains, more particularly, to a door knocker that is characterized by the display of alpha characters.

BACKGROUND OF THE INVENTION

Door knockers have been used for decades and are typically attached to the front surface of a residential door. One example is found in U.S. Pat. No. 602,573 to Coggeshall. Although these door knockers have taken on a variety of different configurations, the prior art has not provided a door knocker in which the knocker piece itself is in the form of an alpha character.

Accordingly, it is an object of the present invention to provide an improved door knocker and one in which there is provided a front display piece that is in the form of an alpha character piece.

SUMMARY OF THE INVENTION

To accomplish the foregoing and other objects, features and advantages of the present invention, there is provided a door knocker that is comprised of a front display piece that is in the form of an alpha character piece including a front facing surface for display of the alpha character and a rear facing surface having at least one rearwardly directed flange member that forms part of a pivot means for the front display piece. The door knocker also includes a rear support piece that is adapted for attachment to the face of the door. The front display piece includes a knocker and is meant to pivot relative to the fixed position rear support piece. The rear support piece includes at least a first leg for pivotal engagement with the flange member and forming another part of the pivot means. The rear support piece also includes a second leg that is for attachment to the door. Moreover, the rear support piece further includes a third leg that forms a knocker that is selectively engageable with the rear facing surface of the alpha character piece.

In accordance with other aspects of the present invention, the alpha character piece is in the form of an outline of an alpha character; a pair of spacedly disposed flange members may be provided including a pivot pin disposed between the flange members; the pivot pin may be disposed between the flange member and first leg; the leg may be disposed substantially horizontally; the second leg disposed substantially vertically and the third leg disposed substantially horizontally; the second leg has one or more holes to facilitate attachment of the second leg to the door; including a pair of second legs; wherein the second leg may be in a u-shape; wherein the second leg may be in an a-shape; wherein the second leg may be in a v-shape; and wherein the second leg may be in a zig-zag shape.

DESCRIPTION OF THE DRAWINGS

Numerous other objects, features and advantages of the present invention will now be realized by consideration of the following detailed description taken in conjunction with the accompanying drawings, in which.

DETAILED DESCRIPTION

Reference is made to the drawings which include FIGS. 1-32. These drawings depict various embodiments of the support for the door knocker. In all embodiments there is some common subject matter including a front display piece which is illustrated in the first embodiment in FIGS. 1-8 representative of the alpha letter "B".

Figure 1:
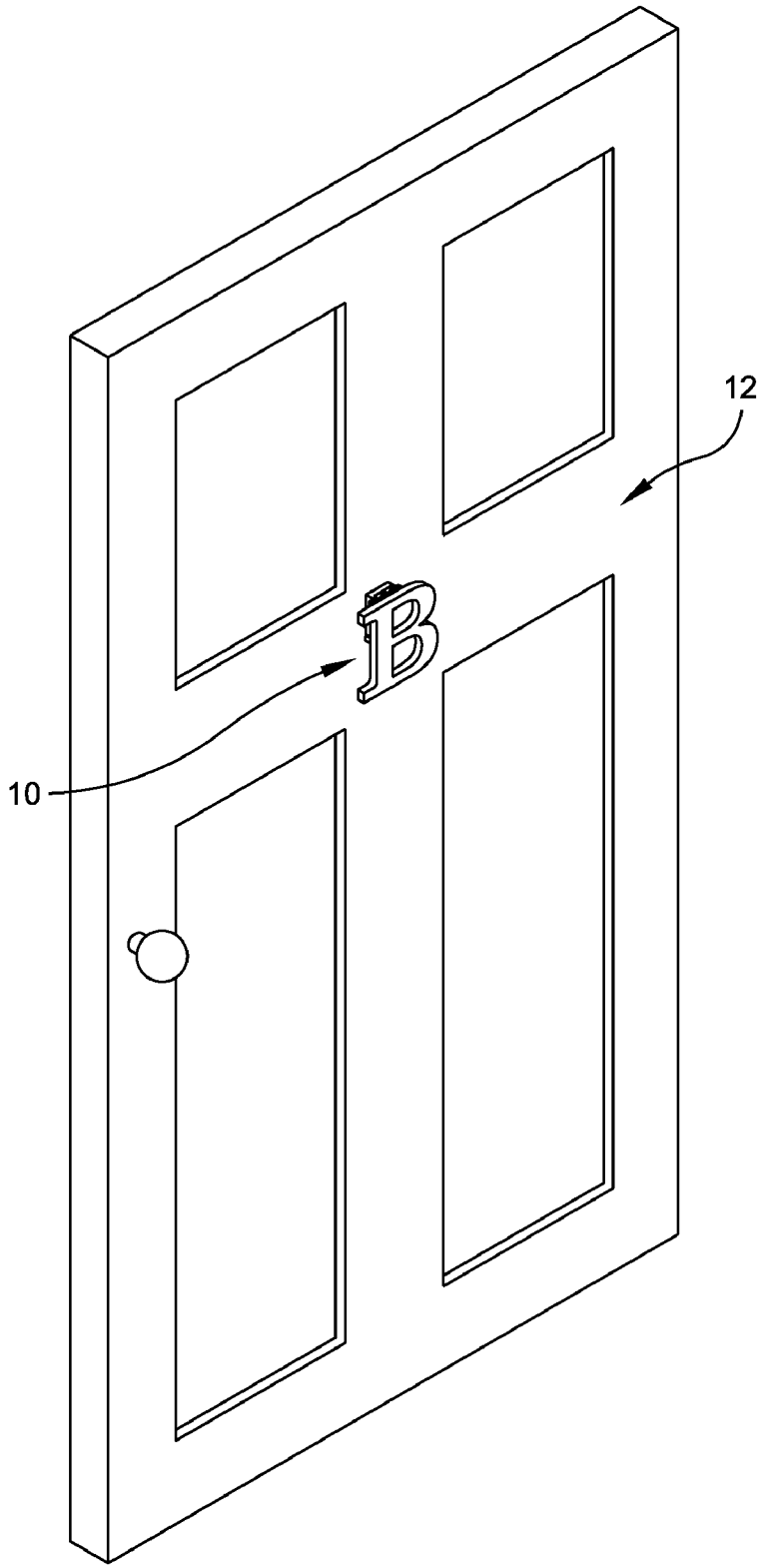
FIG. 1 is a perspective view of a door with the door knocker of the present invention attached thereto.

Thus, and with reference to FIG. 1, there is shown the door knocker at 10 as attached to a door 12. The door knocker is attached on the front visible face of the door 12 so that the knocker is readily viewable as one approaches the door. In accordance with the present invention, there is provided an alpha character piece that thus provides the dual function of operating as a door knocker but also identifying, for example, the last name of the residents of the home such as the depicted letter "B" that could be representative of the last name "Baker", for example.

Figure 2:
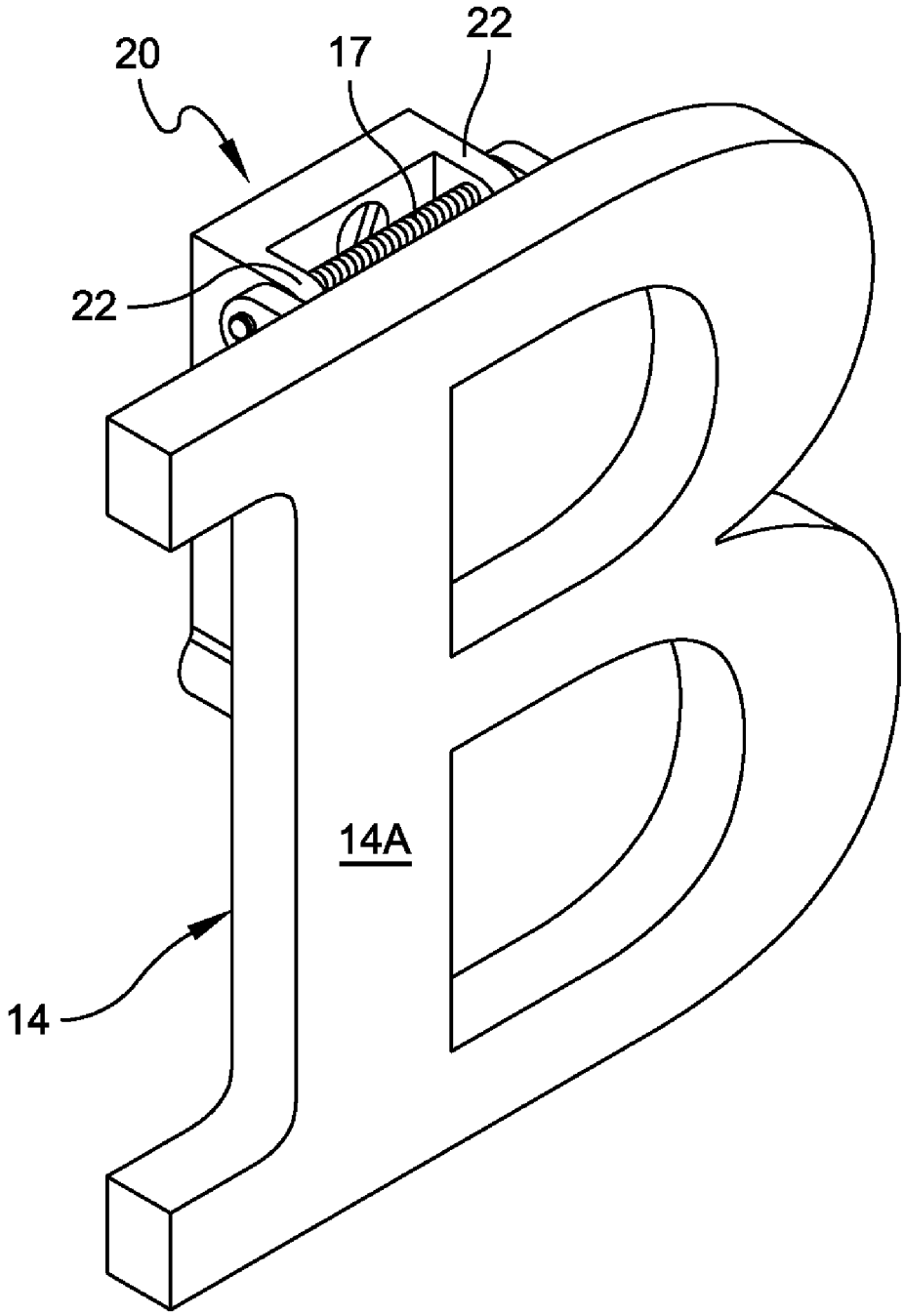
FIG. 2 is a front perspective view of a first type of alpha character, namely the letter "B"
Figure 3:
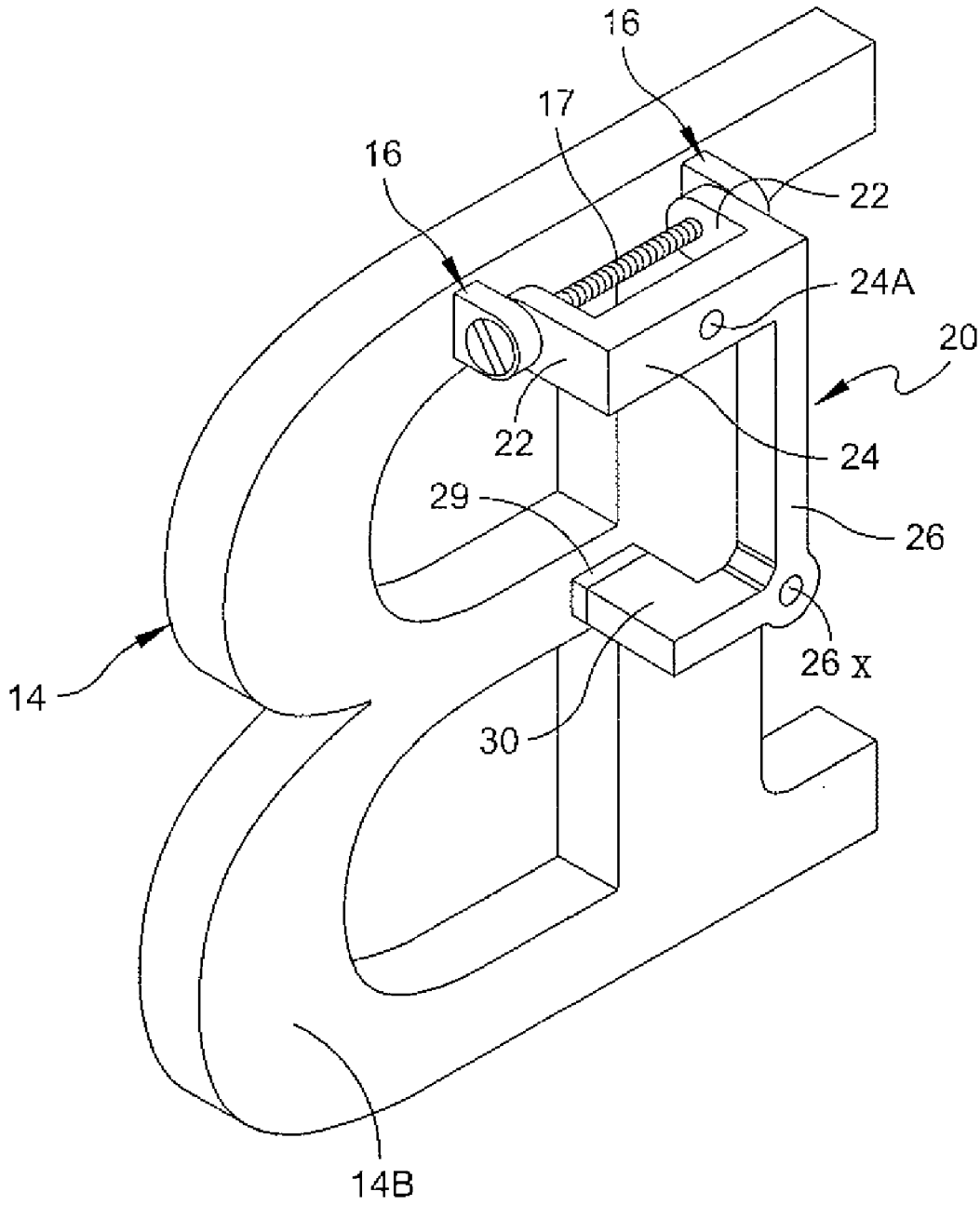
FIG. 3 is a rear perspective view of the embodiment illustrated in FIGS. 1 and 2.
Figure 4:
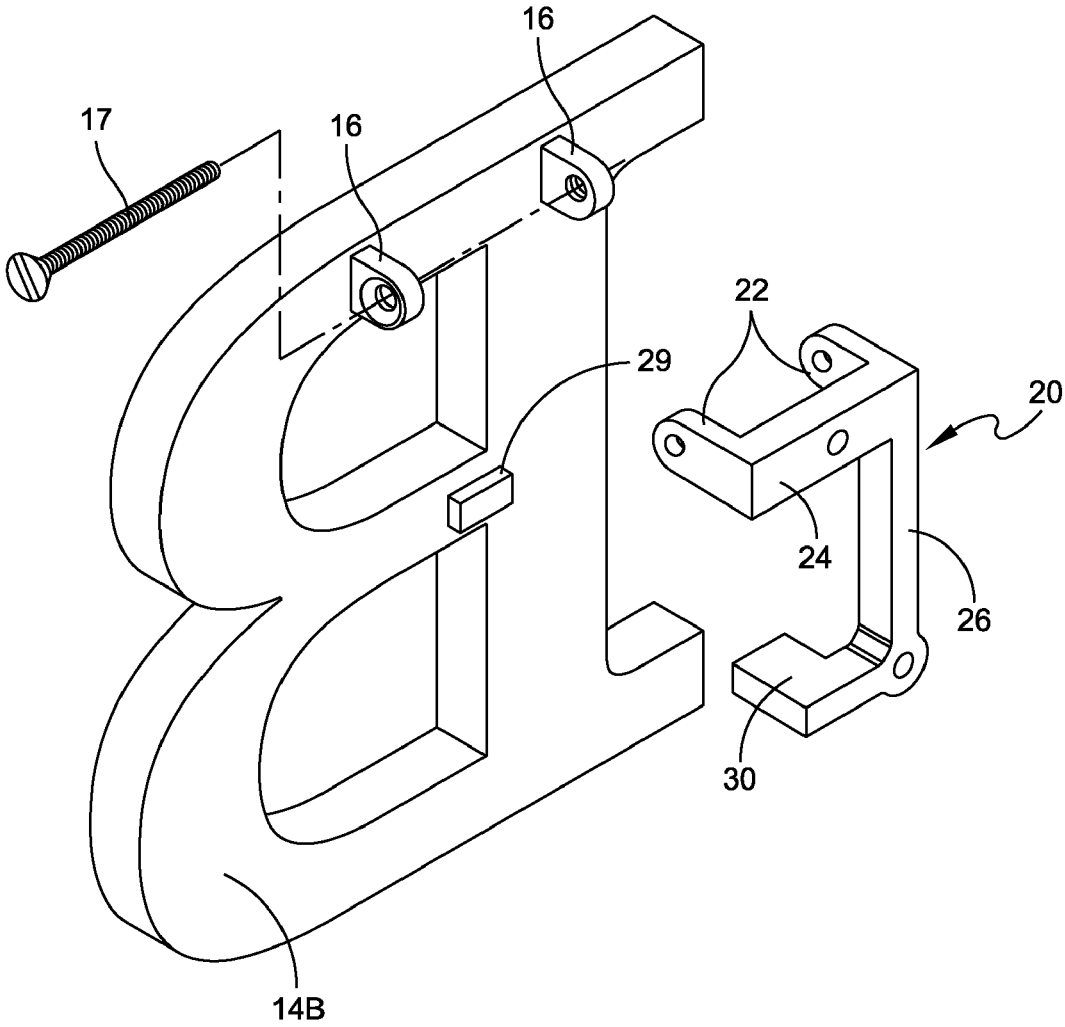
FIG. 4 is an exploded rear perspective view of the embodiment illustrated in FIGS. 1 and 2.
Figure 5:
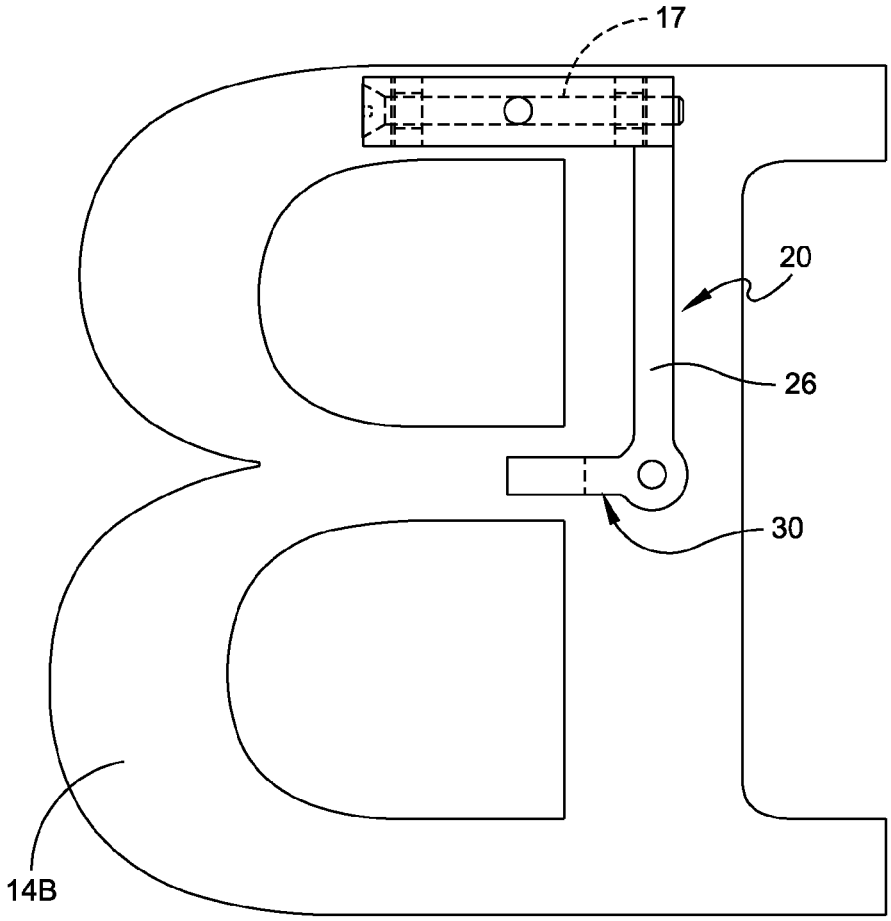
FIG. 5 is a rear view of the embodiment illustrated in FIGS. 1 and 2.
Figure 6:
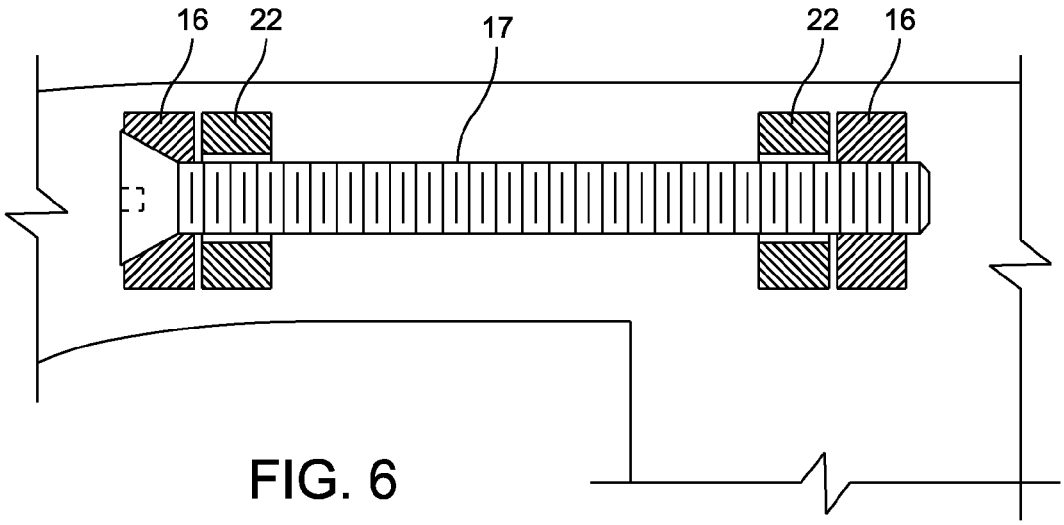
FIG. 6 is an enlarged fragmentary view at the rear.
Figure 7:
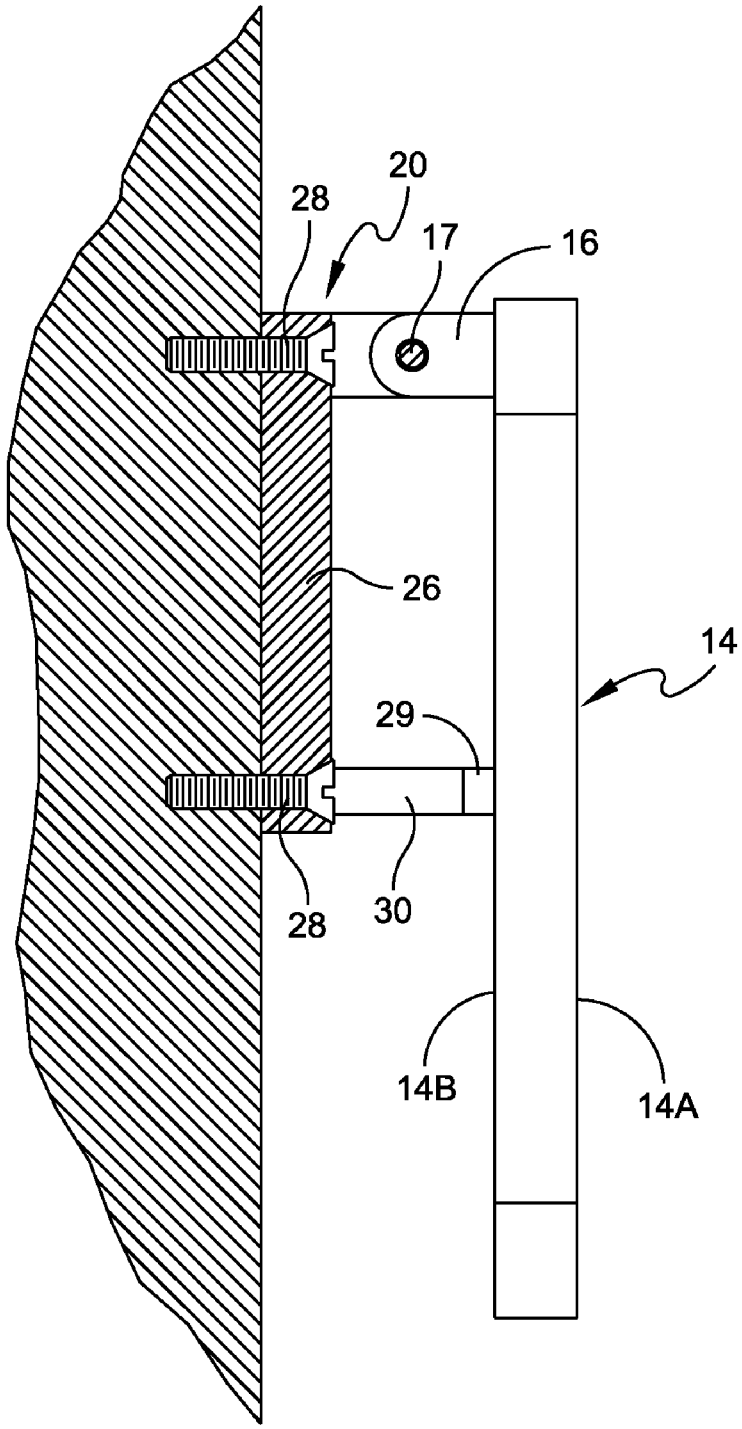
FIG. 7 is a cross-sectional view showing the manner in which the door knocker is attached to the door.
Figure 8:
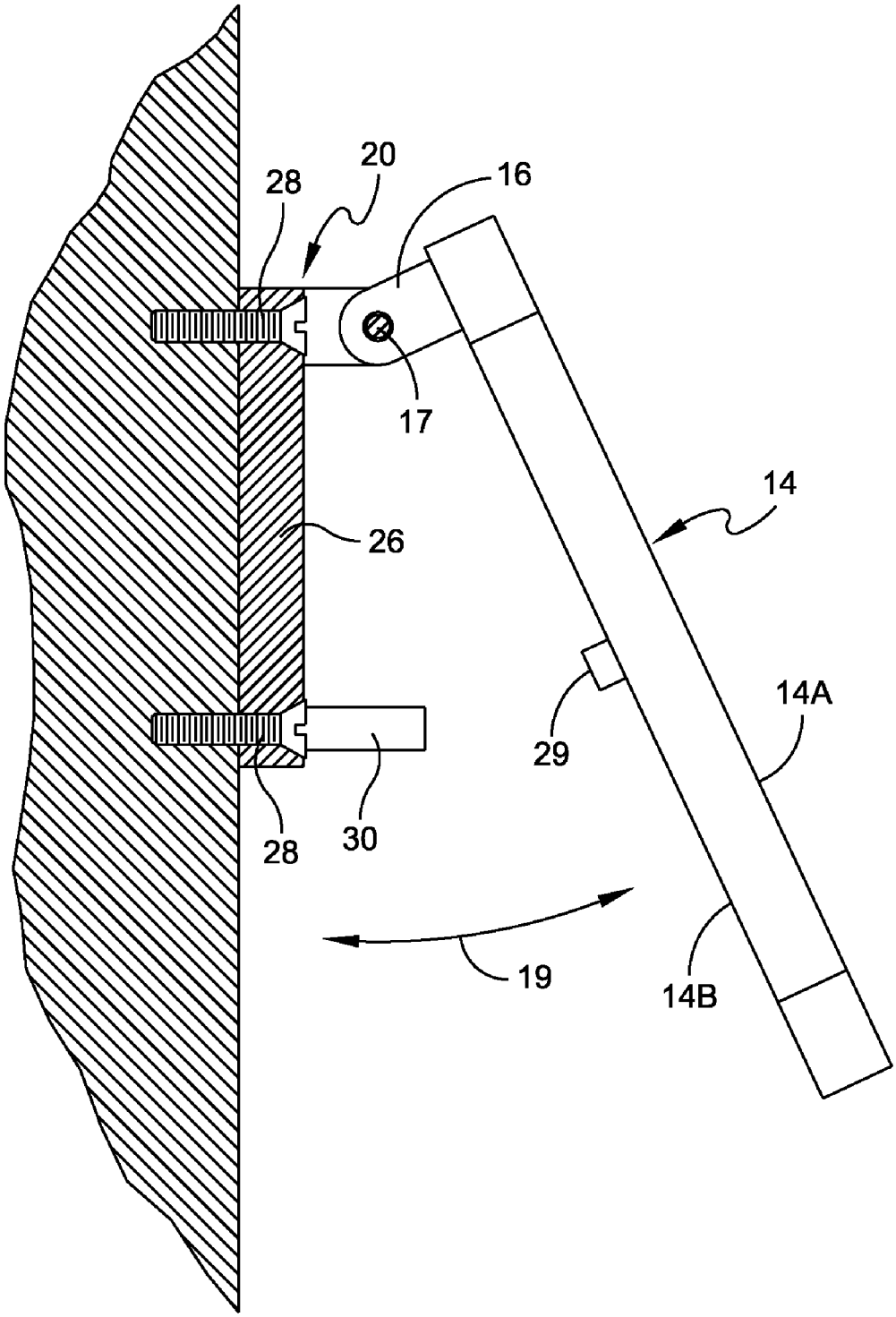
FIG. 8 is a cross-sectional view similar to that shown in FIG. 7 but illustrating the knocker being pivoted to a more open position.
Figure 9:
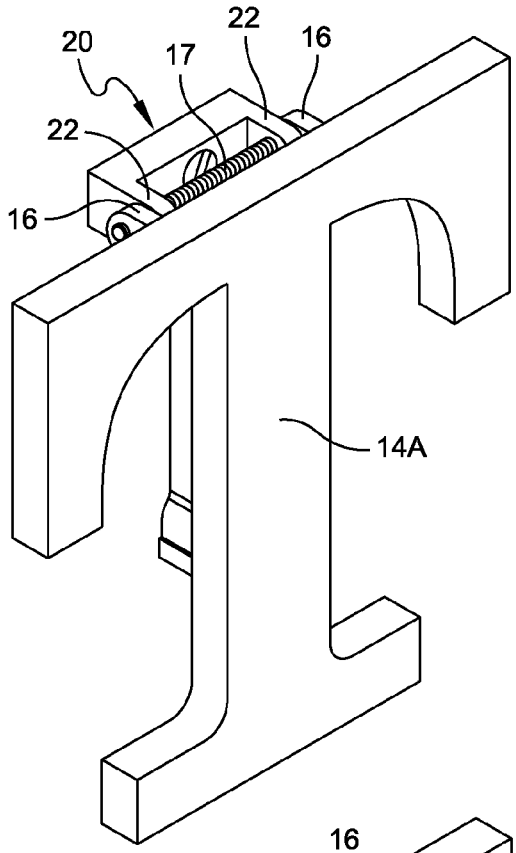
FIGS. 9 and 10 are respective front and rear perspective views of a door knocker for displaying the letter "T"
Figure 10:
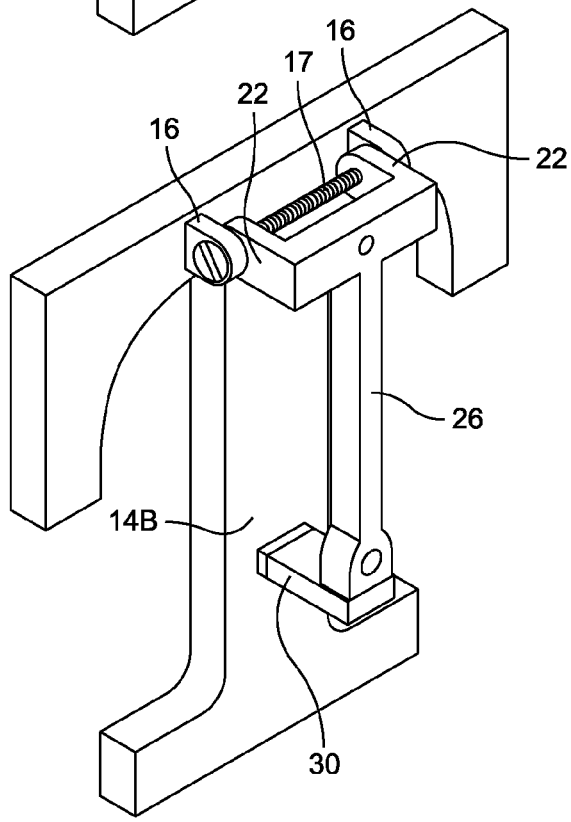

Now, with regard to the first embodiment shown in FIGS. 1-8, FIG. 2 is a front perspective view of a first type of alpha character, namely the letter "B"; FIG. 3 is a rear perspective view of the embodiment illustrated in FIGS. 1 and 2; FIG. 4 is an exploded rear perspective view of the embodiment illustrated in FIGS. 1 and 2; FIG. 5 is a rear view of the embodiment illustrated in FIGS. 1 and 2; FIG. 6 is an enlarged fragmentary view at the rear; FIG. 7 is a cross-sectional view showing the manner in which the door knocker is attached to the door; and FIG. 8 is a cross-sectional view similar to that shown in FIG. 7 but illustrating the knocker being pivoted to a more open position.

With further reference to FIGS. 1-8, the door knocker is comprised of a front display piece 14 that is in the form of an alpha character piece. The display piece 14 includes a front facing surface 14A that displays the alpha character and a rear facing surface 14B having at least one rearwardly facing flange member 16. In this first embodiment, there are a pair of flange members 16 and these flange members form part of a pivot means for the front display piece. The door knocker also includes a rear support piece 20 that is comprised of a plurality of integrally formed but separate leg members. The rear support piece 20 includes a pair of first legs 22 interconnected by a bridge member 24. The rear support piece 20 also includes, contiguous with the legs 22, a second leg 26. The legs 22 may be considered as being disposed substantially horizontally while the leg 26 is disposed substantially vertically. The bottom of the leg 26 is provided with a hole 26X and the bridge member 24 is also provided with a hole 24A. These holes are for accommodating screws 28, such as illustrated in FIGS. 7 and 8 for attachment of the knocker to the door. Lastly, the rear support piece 20 includes a third lower leg 30. It is the free end of the leg 30 that contacts the base 29 to provide the knocking action. The base 29 is a small piece that is attached to the rear surface 14B of the alpha character piece 14. The front display piece and the rear support piece are preferably both constructed of a metal material, although, other types of materials may also be employed in constructing the door knocker of the present invention.

As indicated previously, the front display piece has flanges 16 that form part of a pivot means. The basic pivot means is illustrated by the pivot pin or screw 17 such as illustrated in FIGS. 2-4. Refer also to FIGS. 5 and 6, and in particular FIG. 6 which illustrates the screw or pin 17 extending through the legs 22 as well as being secured at the flanges 16. This arrangement provides a pivot means by which the knocker can be pivoted between the position illustrated in FIG. 7 and that illustrated in FIG. 8. FIG. 8 would be the open position and FIG. 7 would be considered the contact position. In FIG. 8 the arrow 19 illustrates the direction of pivoting.

Figure 11:
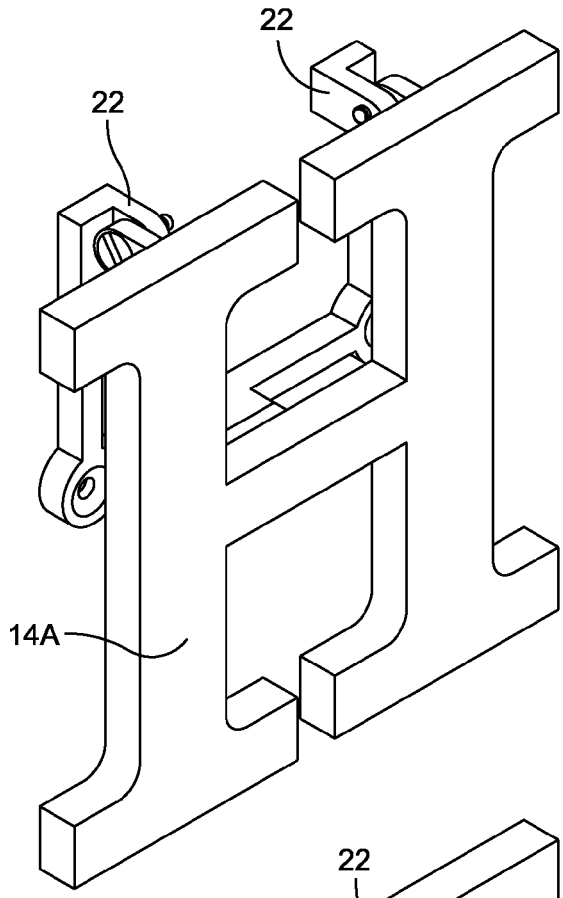
FIGS. 11 and 12 are respective front and rear perspective views of a door knocker for displaying the letter "H"
Figure 12:
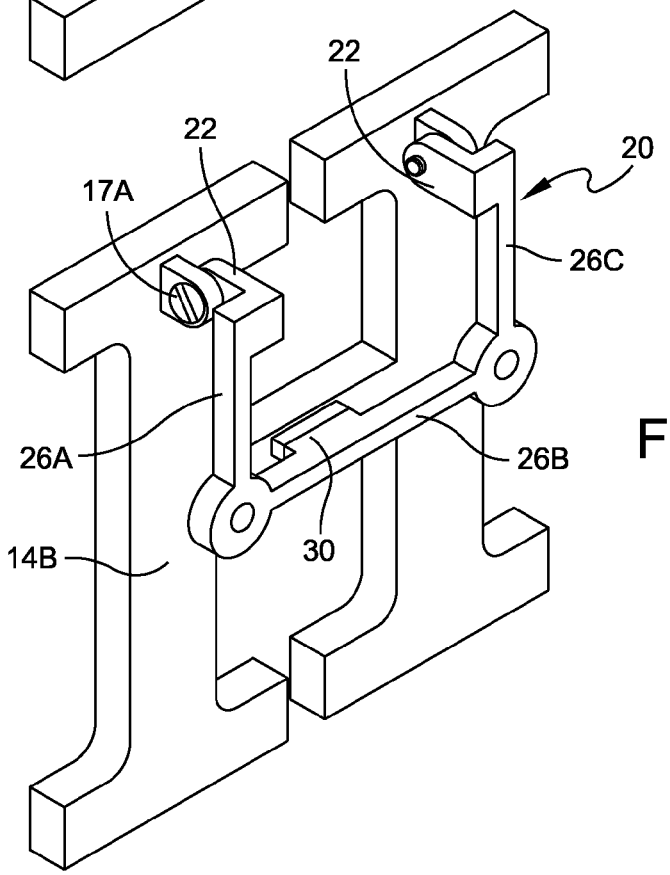

Reference is now made to FIGS. 11 and 12 for respective front and rear perspective views associated with the support of the letter "H". The support mechanisms are similar to those illustrated in FIGS. 1-8. Accordingly, there is provided a front display piece 14 having front and rear respective surfaces 14A and 14B. There is also a rear support piece 20 having a first pair of legs 22. Rather than a single pivot pin, in this embodiment there are provided opposite pairs of pivot pins 17A. Also, instead of the single vertical leg 26 there are three legs two of which are vertical and one of which is horizontal. This includes the vertical legs 26A and 26C and the horizontal leg 26B. All of these legs are contiguous with each other. Again, holes are provided in the rear support piece so that the rear support piece can be screwed or bolted to the door.

Figure 13:
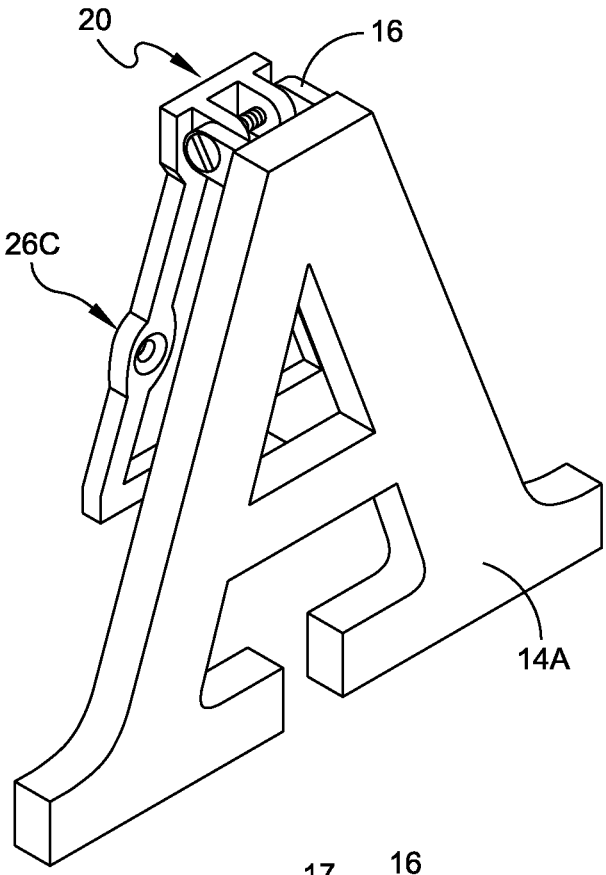
FIGS. 13 and 14 are respective front and rear perspective views of a door knocker for displaying the letter "A"
Figure 14:
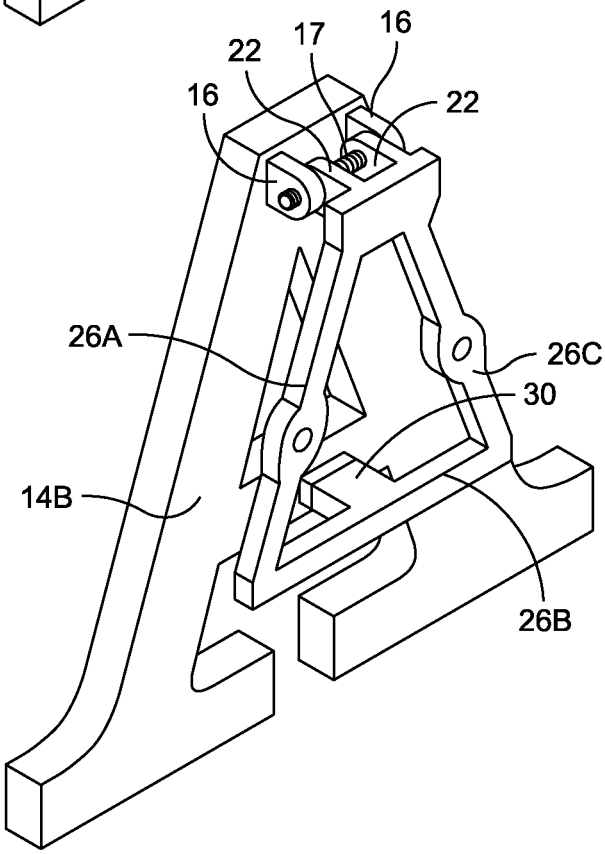
Figure 15:
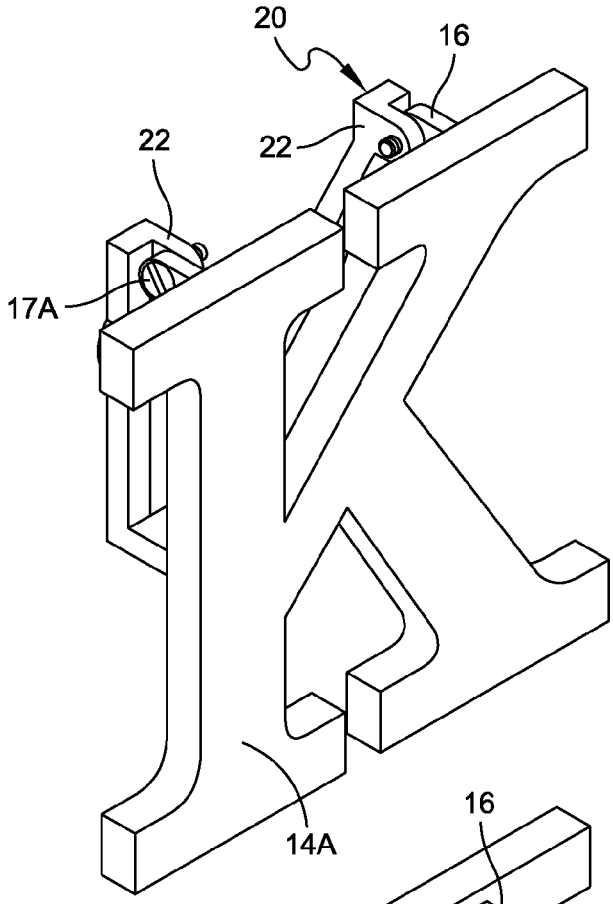
FIGS. 15 and 16 are respective front and rear perspective views of a door knocker for displaying the letter "K"
Figure 16:
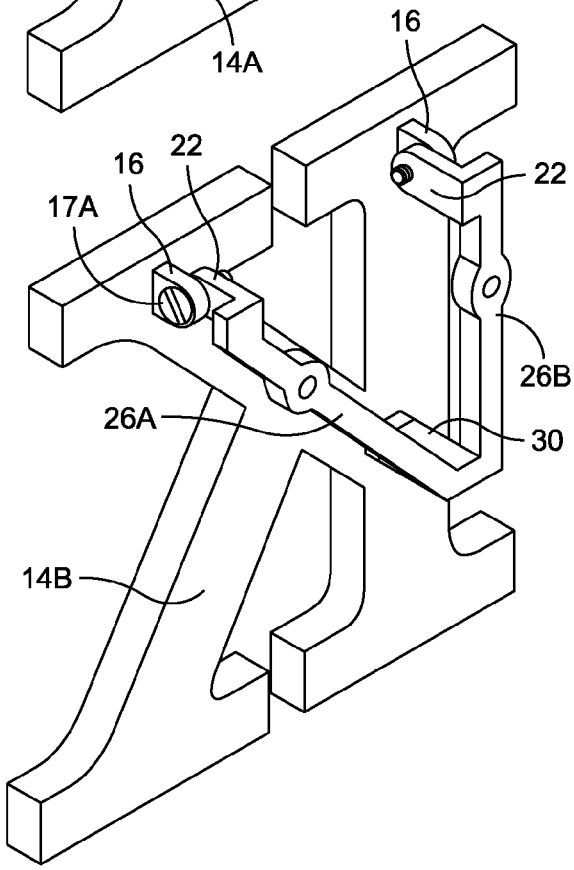

Reference is now made to a further embodiment of the present invention illustrated in FIGS. 13 and 14 representative of a door knocker for displaying the letter "A". As with the previous embodiments, this also includes a front display piece having respective front and rear surfaces 14A and 14B and a rear support piece 20. The front display piece has the aforementioned flanges 16 and the rear support piece has a pair of legs 22. Together the flange members and legs form a pivot means illustrated by the single pivot pin 17. The rear support piece also includes legs 26A, 26B and 26C formed in an A-shape. The knocker leg 30 is shown supported contiguously from a center area of the lower leg 26B. Appropriate holes are provided in legs 26A and 26C so that the rear support piece can be fixedly attached to a door.

Reference is now made to a further embodiment of the present invention in the form of a door knocker for displaying the alpha character piece "K". As in the previous embodiments, the front display piece has respective front and rear surfaces 14A and 14B. There is also provided the rear support piece 20 which in this particular embodiment is provided with upper legs 22 engageable with the flange member 16 by means of corresponding pivot pins 17A. This particular embodiment also includes V-shaped legs 26A and 26B having at the bottom thereof the aforementioned third leg 30 that forms the knocker surface.

Figure 17:
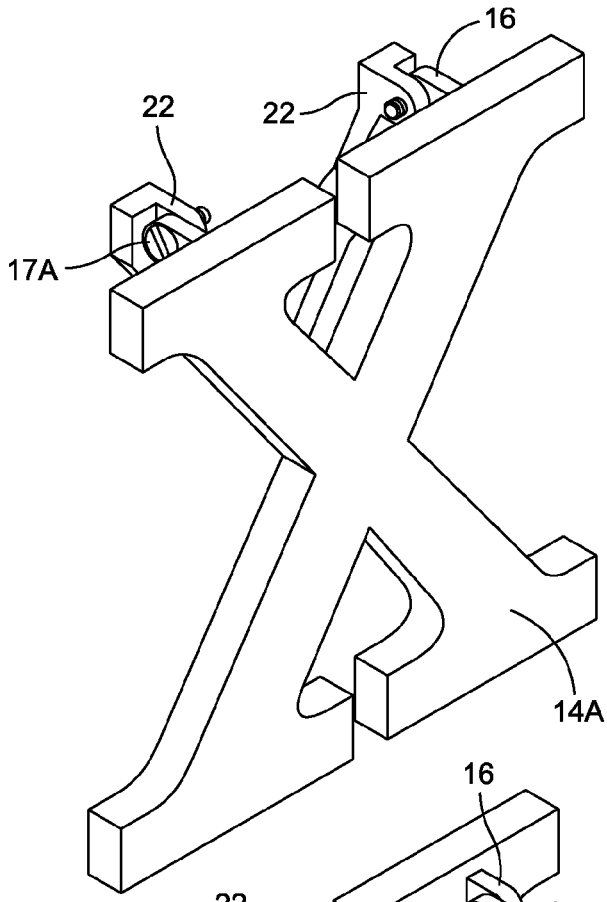
FIGS. 17 and 18 are respective front and rear perspective views of a door knocker for displaying the letter "X"
Figure 18:
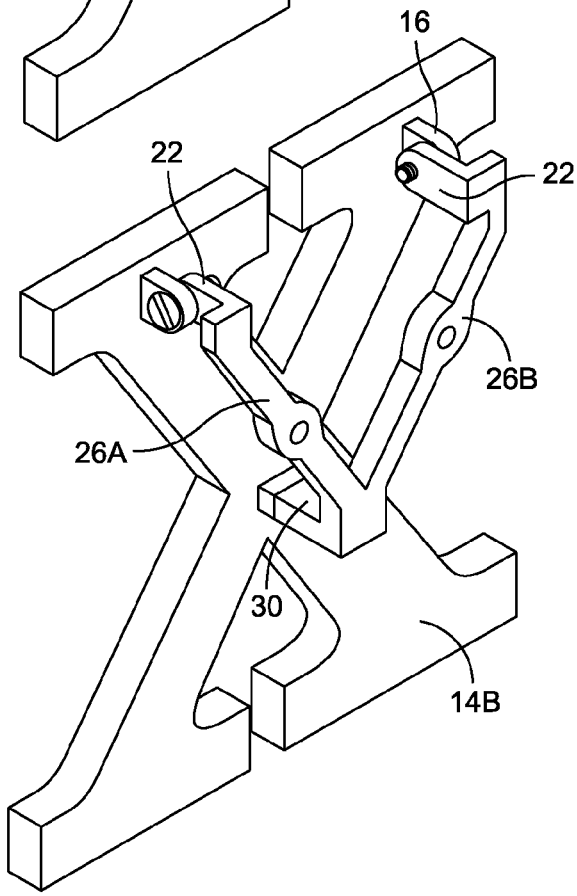

Reference is now made to FIGS. 17 and 18 for a further embodiment of the present invention in the form of a door knocker for displaying the alpha character piece "X". As in the previous embodiments, the front display piece has respective front and rear surfaces 14A and 14B. There is also provided the rear support piece 20 which in this particular embodiment is provided with upper legs 22 engageable with the flange member 16 by means of corresponding pivot pins 17A. This particular embodiment also includes V-shaped legs 26A and 26B having at the bottom thereof the aforementioned third leg 30 that forms the knocker surface.

Figure 19:
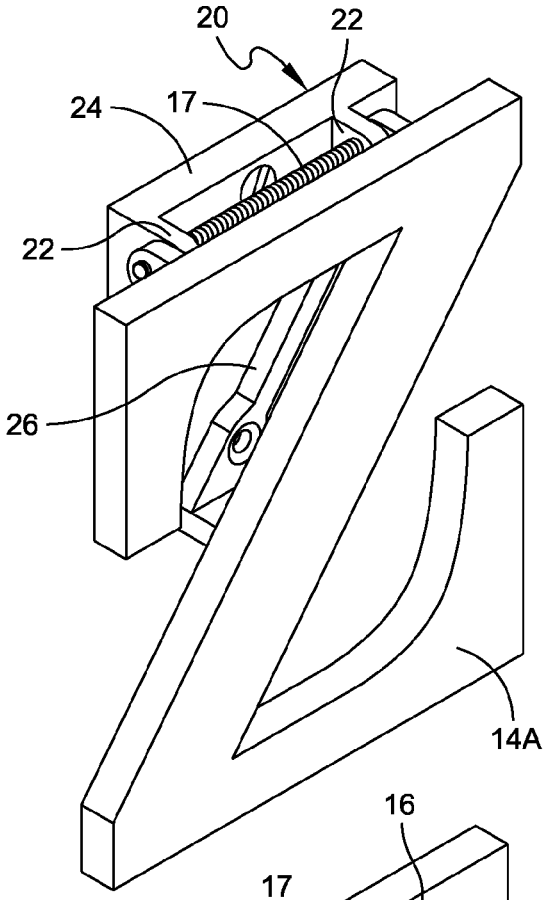
FIGS. 19 and 20 are respective front and rear perspective views of a door knocker for displaying the letter "Z"
Figure 20:
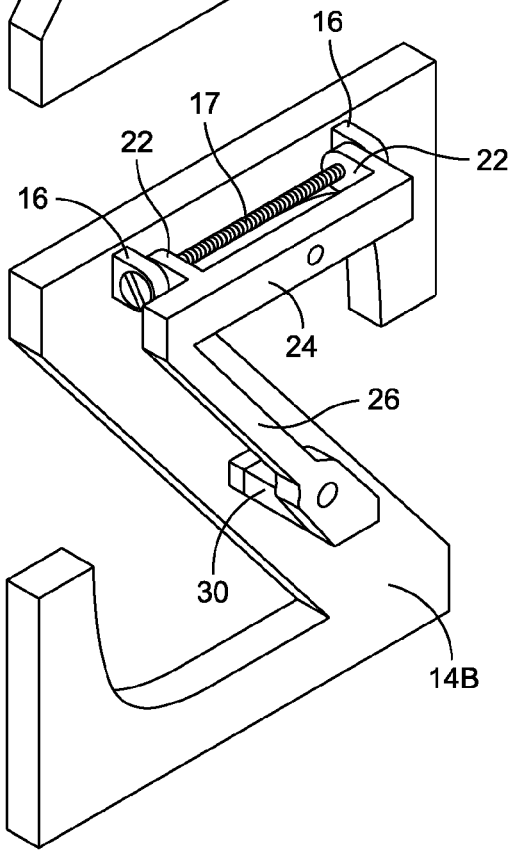

Reference is now made to a further embodiment illustrated in FIGS. 19 and 20. This embodiment is representative of a display of the letter "Z". As with previous embodiments, the front display piece is provided with respective front and rear surfaces 14A and 14B. Also illustrated is the rear support piece 20 which in this embodiment is comprised of legs 22 that are pivotally engageable with flange member 16. The pin 17 interconnects the spaced apart flange members and legs. A bridge member 24 interconnects the legs 22 and a second leg 26 is provided for connecting from the bridge member 24 to the third leg represented by the knocker 30.

Figure 21:
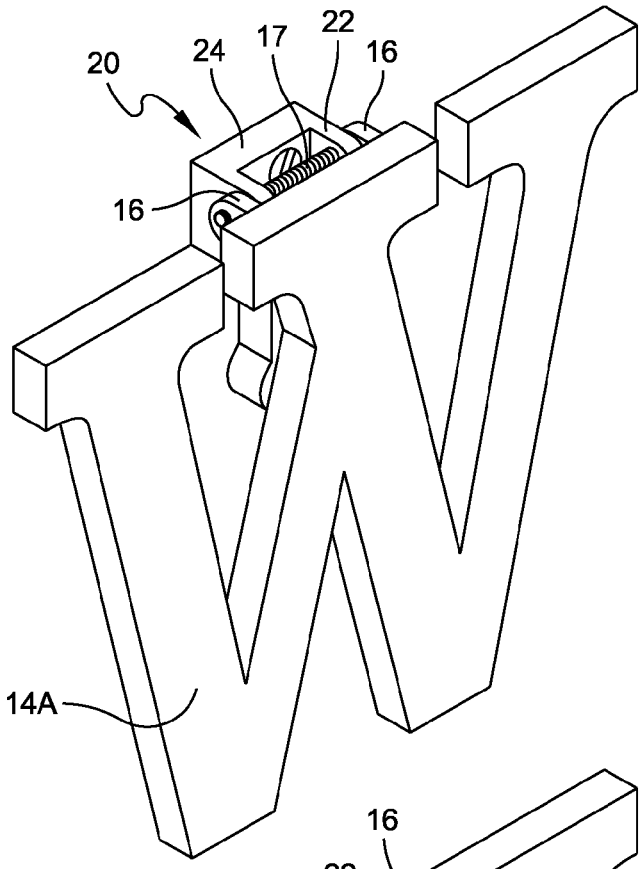
FIGS. 21 and 22 are respective front and rear perspective views of a door knocker for displaying the letter "W"
Figure 22:
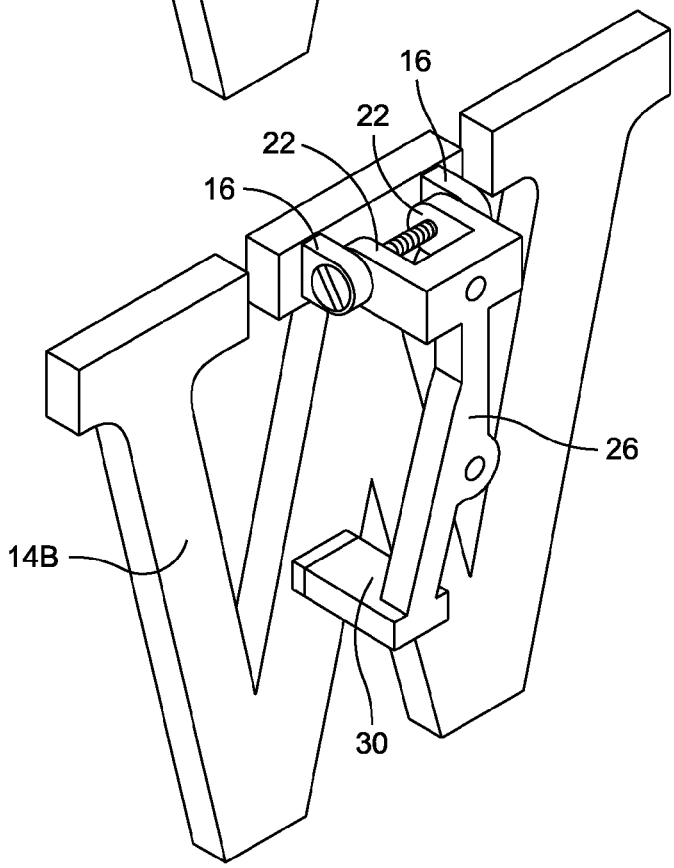

Reference is now made to a further embodiment illustrated in FIGS. 21 and 22. This embodiment is representative of a display of the letter "W". As with previous embodiments, the front display piece is provided with respective front and rear surfaces 14A and 14B. Also illustrated is the rear support piece 20 which in this embodiment is comprised of legs 22 that are pivotally engageable with flange member 16. The pin 17 interconnects the spaced apart flange members and legs. A bridge member 24 interconnects the legs 22 and a second leg 26 is provided for connecting from the bridge member 24 to the third leg represented by the knocker 30.

Figure 23:
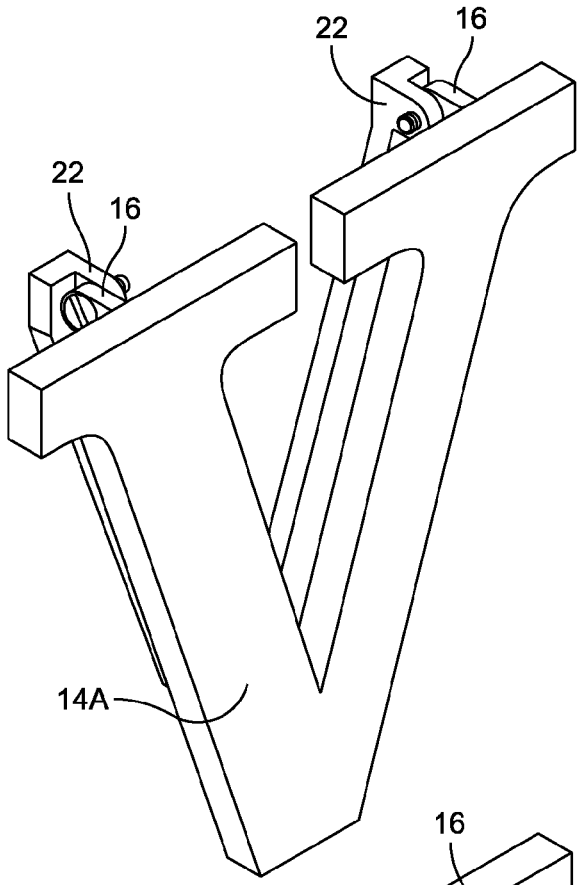
FIGS. 23 and 24 are respective front and rear perspective views of a door knocker for displaying the letter "V"
Figure 24:
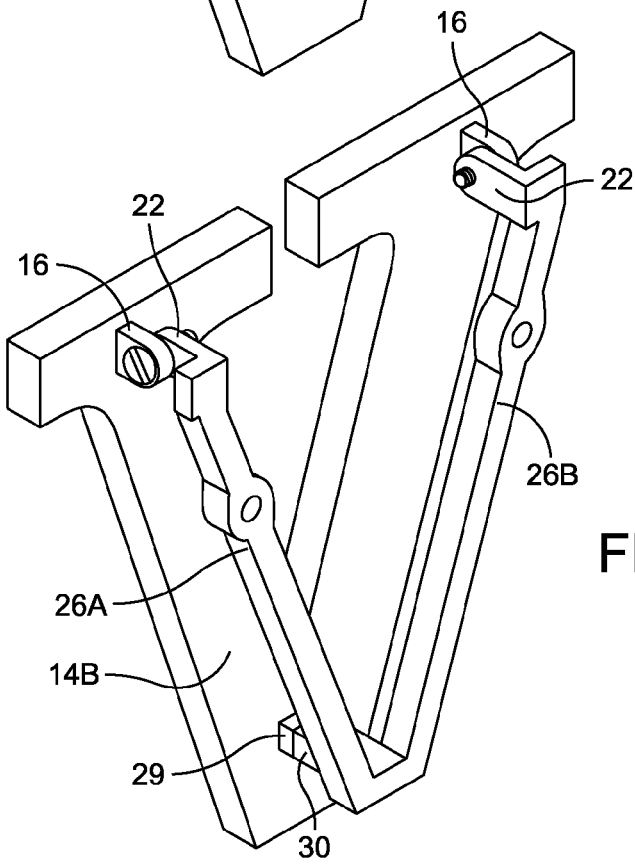

Reference is now made to FIGS. 23 and 24 for a further embodiment of the present invention in the form of a door knocker for displaying the alpha character piece "V". As in the previous embodiments, the front display piece has respective front and rear surfaces 14A and 14B. There is also provided the rear support piece 20 which in this particular embodiment is provided with upper legs 22 engageable with the flange member 16 by means of corresponding pivot pins 17A. This particular embodiment also includes V-shaped legs 26A and 26B having at the bottom thereof the aforementioned third leg 30 that contacts the base 29.

Figure 25:
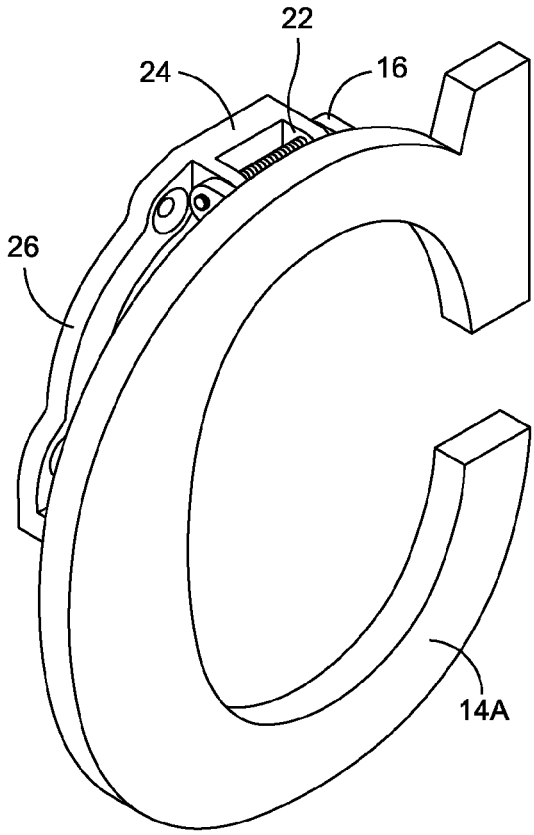
FIGS. 25 and 26 are respective front and rear perspective views of a door knocker for displaying the letter "C"
Figure 26:
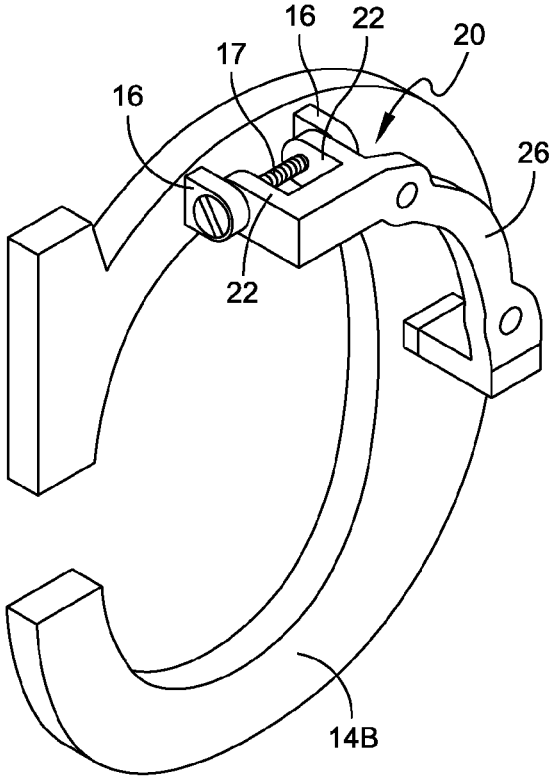

Reference is now made to a further embodiment illustrated in FIGS. 25 and 26. This embodiment is representative of a display of the letter "C". As with previous embodiments, the front display piece is provided with respective front and rear surfaces 14A and 14B. Also illustrated is the rear support piece 20 which in this embodiment is comprised of legs 22 that are pivotally engageable with flange member 16. The pin 17 interconnects the spaced apart flange members and legs. A bridge member 24 interconnects the legs 22 and a second leg 26 is provided for connecting from the bridge member 24 to the third leg.

Figure 27:
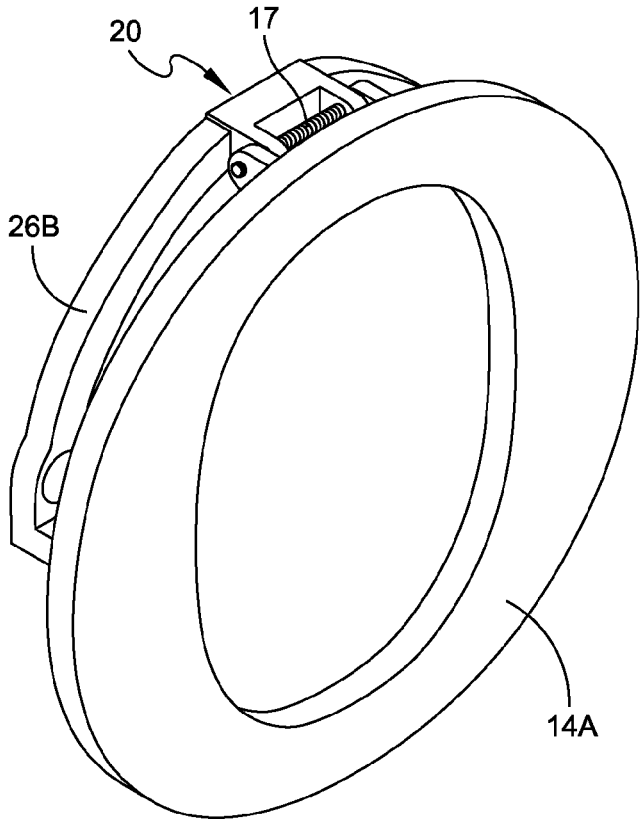
FIGS. 27 and 28 are respective front and rear perspective views of a door knocker for displaying the letter "O"
Figure 28:
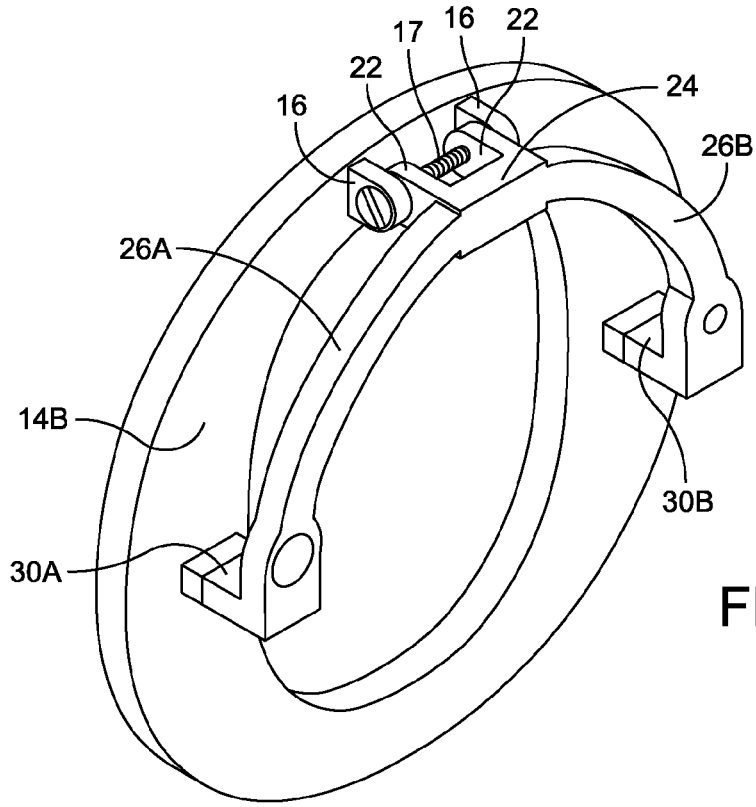

Reference is now made to the embodiment illustrated in FIGS. 27 and 28 for a display of the alpha character piece for the letter "O". This embodiment is similar to embodiments previously described and thus includes a front display piece 14 having respective outer and inner surfaces 14A and 14B. The rear support piece 20 does include legs 26A and 26B with a bridge member 24 for support of the top legs 22. Each of the legs 22 engage with a corresponding flange member 16 and the pivot is provided by means of the pivot pin 17. This embodiment differs from previous ones in that each of the legs 26A and 26B support at the distal end thereof respective legs 30A and 32B.

Figure 29:
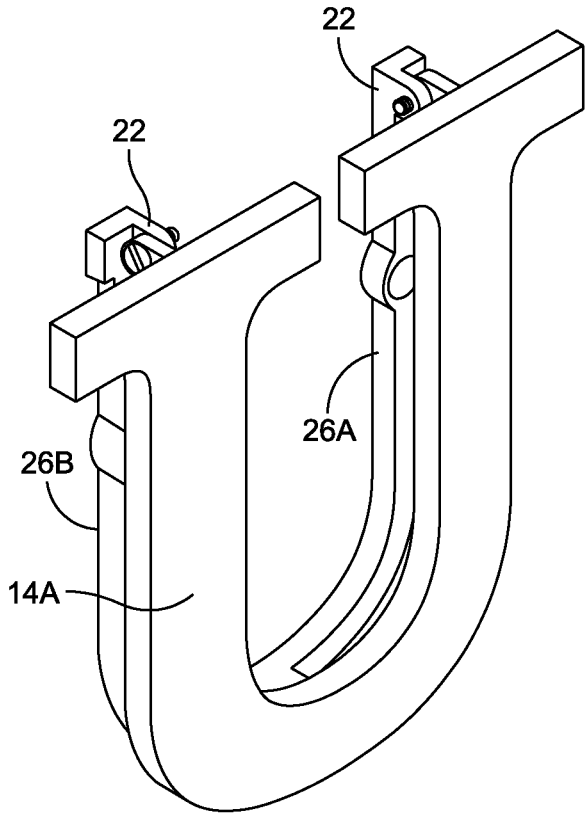
FIGS. 29 and 30 are respective front and rear perspective views of a door knocker for displaying the letter "U"
Figure 30:
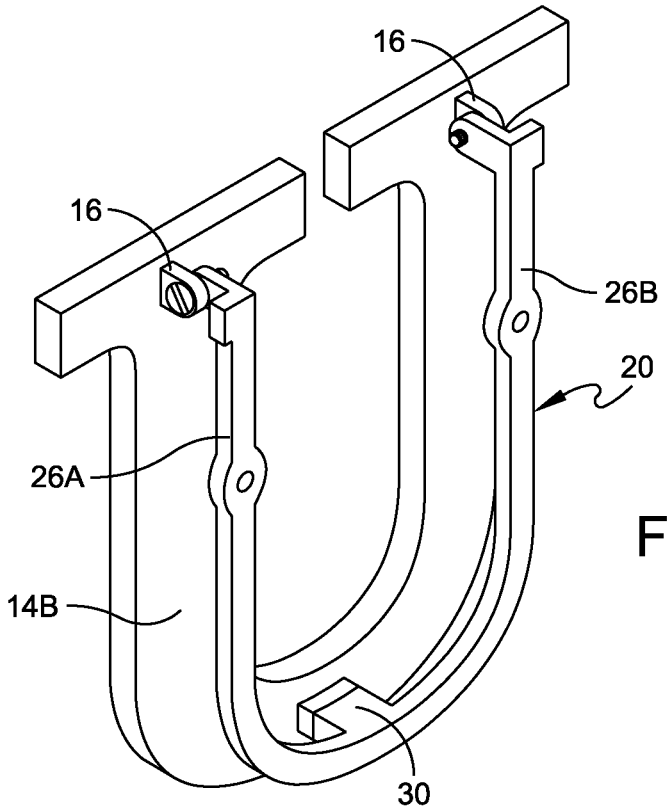

Reference is now made to FIGS. 29 and 30 for a further embodiment of the present invention in the form of a door knocker for displaying the alpha character piece "U". As in the previous embodiments, the front display piece has respective front and rear surfaces 14A and 14B. There is also provided the rear support piece 20 which in this particular embodiment is provided with upper legs 22 engageable with the flange member 16 by means of corresponding pivot pins 17A. This particular embodiment also includes V-shaped legs 26A and 26B having at the bottom thereof the aforementioned third leg 30 that forms the knocker surface.

Figure 31:
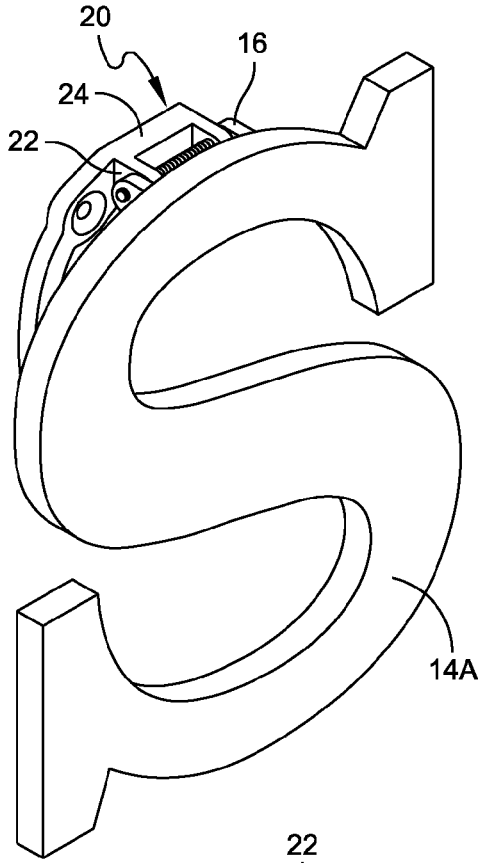
FIGS. 31 and 32 are respective front and rear perspective views of a door knocker for displaying the letter "S".
Figure 32:
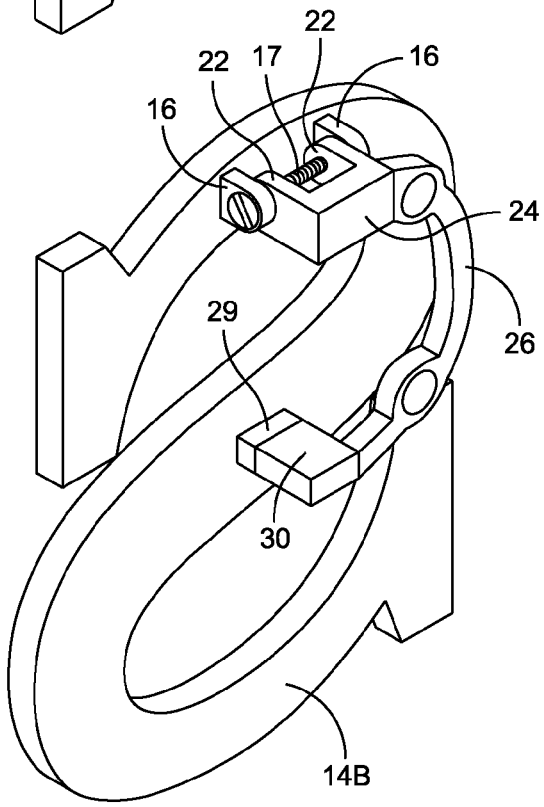

Another embodiment of the invention is illustrated in the respective front and rear perspective views of FIGS. 31 and 32. This is representative of the alpha character "S". In this embodiment of the invention the front display piece 14 is provided with a respective front surface 14A and rear surface 14B. The rear support piece 20 again is comprised of an upper pair of legs 22 that engage with the flange member 16 and that form a pivot by means of the pivot pin 17. A bridge 24 interconnects the legs 22. A second leg member represented by the leg 26 extends from the bridge 24 down, in a curved manner, to the lower disposed knocker leg 30. Appropriate holes are provided in the leg 26 for attachment of the rear support piece to the door.

Having now described a limited number of embodiments of the present invention, numerous other embodiments and modifications thereof are contemplated as falling within the scope of the present invention as defined by the appended claims. For example, although all letters of the alphabet have not been shown, it is to be understood that all letters can be supported by one of the disclosed mechanisms. For example, the first embodiment supporting the letter "B" could also be used for support of the letter "P".

What is claimed is:

1. A door knocker for attachment to the face of a door, comprising:

a front display piece;

said front display piece in the form of an alpha character piece including a front facing surface for display of the alpha character and a rear facing surface having a pair of spacedly disposed rearwardly directed flange members that form part of a pivot means for the front display piece;

a rear support piece that is for attachment to the face of the door;

said rear support piece including a first member for pivotal engagement with the flange members and forming another part of the pivot means;

said first member including a bridge member that extends between the flange members, and having, at respective ends thereof, integrally formed legs that extend substantially orthogonal to the bridge member and that form with the spacedly disposed flange members the pivot means;

said pivot means also comprised of an elongated pivot pin that extends between the orthogonal legs and flange members;

said rear support piece also including a second member that is contiguous with said first member;

said second member including an elongated piece that extends substantially downwardly from said bridge member;

said rear support piece further including a third member that is contiguous with said second member, and that includes a leg extending transverse to said elongated piece having a knocker surface that is selectively engageable with the rear facing surface of the alpha character piece.

2. The door knocker of claim 1 wherein the alpha character piece outlines an alphabetic character.

3. The door knocker of claim 1 wherein said elongated piece extends substantially orthogonal to said bridge member.

4. The door knocker of claim 3 wherein the elongated piece extends from an end of said bridge member.

5. The door knocker of claim 3 wherein the elongated piece extends from a middle of said bridge member.

6. The door knocker of claim 1 wherein the elongated piece has a hole therein for receiving a fastener for securing the support piece to the face of the door.

7. The door knocker of claim 6 wherein the hole in the elongated piece is disposed at the end that is contiguous with third member.

8. The door knocker of claim 7 wherein the bridge member also has a hole therein for receiving a fastener for securing the support piece to the face of the door.

9. The door knocker of claim 1 wherein the bridge member has a length on the order of the spacing between the flange members.

10. The door knocker of claim 9 wherein the pin has a length on the order of the spacing between the flange members.

11. The door knocker of claim 1 wherein said elongated piece is comprised of a pair of elongated pieces that extend angularly from said bridge member.

12. The door knocker of claim 1 wherein said elongated piece extends angularly from said bridge member.

13. The door knocker of claim 1 wherein said elongated piece extends arcuately from said bridge member.

14. The door knocker of claim 1 including a base piece that extends from the rear facing surface of the front display piece, and wherein said third member has a free end for contact with said base piece.

15. A door knocker for attachment to the face of a door and comprising:

a front display piece;

said front display piece in the form of an alpha character piece including a front facing surface for display of the alpha character and a rear facing surface having a pair of spacedly disposed rearwardly directed flange members that form part of a pivot means for the front display piece;

a rear support piece that is for attachment to the face of the door;

said rear support piece including a first member for pivotal engagement with the flange members and forming another part of the pivot means;

said first member including a pair of spacedly disposed legs that each extend toward the front display piece and that form with the spacedly disposed flange members the pivot means;

said pivot means comprised of a pair of pivot pins with each pivot pin for connection of a respective flange member with a first member leg;

said rear support piece also including a second member that is contiguous with said first member;

said second member including a pair of elongated pieces that extend downwardly from respective first member legs;

said rear support piece further including a third member that is contiguous with said second member and that includes a leg that extends transverse to said pair of elongated pieces, and having a knocker surface that is selectively engageable with the rear facing surface of the alpha character piece.

16. The door knocker of claim 15 wherein the alpha character piece outlines an alphabetic character.

17. The door knocker of claim 15 wherein said third member leg comprises an elongated leg having respective ends that connect with ends of respective second member elongated pieces.

18. The door knocker of claim 17 including a hole provided at each junction between the elongated piece and third member leg end for receiving respective fasteners for securing the support piece to the face of the door.

19. The door knocker of claim 17 including an extension disposed in the middle of the elongated leg for engagement with a base piece attached to the rear surface of the support piece.

20. The door knocker of claim 17 wherein one of the second member elongated pieces is disposed angularly.

* * * * *